US006848769B2

(12) United States Patent
Murakami

(10) Patent No.: US 6,848,769 B2
(45) Date of Patent: Feb. 1, 2005

(54) LIQUID EJECTING HEAD HAVING A PLURALITY OF GROUPS OF EJECTION OPENINGS, AND IMAGE-FORMING DEVICE USING THE SAME

(75) Inventor: Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 10/173,506

(22) Filed: Jun. 18, 2002

(65) Prior Publication Data

US 2002/0196299 A1 Dec. 26, 2002

(30) Foreign Application Priority Data

Jun. 20, 2001 (JP) ..... 2001/187107

(51) Int. Cl.[7] ..... B41J 2/05
(52) U.S. Cl. ..... 347/56; 347/57
(58) Field of Search ..... 347/44, 47, 56, 347/61, 15, 41, 40, 42, 43, 63, 57–59, 45, 67

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,218,376 A | | 6/1993 | Asai | |
| 5,648,804 A | * | 7/1997 | Keefe et al. | 347/47 |
| 6,155,673 A | | 12/2000 | Nakajima et al. | 347/61 |
| 6,244,688 B1 | * | 6/2001 | Hickman | 347/43 |

FOREIGN PATENT DOCUMENTS

| | | | |
|---|---|---|---|
| JP | 54-56847 | 5/1979 | |
| JP | 59-123670 | 7/1984 | B41J/3/04 |
| JP | 59-138461 | 8/1984 | B41J/3/04 |
| JP | 60-71260 | 4/1985 | B41J/3/04 |
| JP | 4-10940 | 1/1992 | B41J/2/05 |
| JP | 4-10941 | 1/1992 | B41J/2/05 |
| JP | 4-10942 | 1/1992 | B41J/2/05 |

* cited by examiner

*Primary Examiner*—Stephen D. Meier
*Assistant Examiner*—Ly Tran
(74) *Attorney, Agent, or Firm*—Fitzpatrick, Cella, Harper & Scinto

(57) ABSTRACT

A present invention provides a liquid ejection head comprising a plurality of ejection openings arranged in the feeding direction of a printing medium and a plurality of ejection energy generating elements for generating energy used for ejecting liquid from the ejection openings disposed in correspondence to the ejection openings, and subjected to the scanning movement along the printing medium transverse to the feeding direction of the printing medium, wherein the ejection openings are divided into a plurality of groups arranged parallel to the scanning movement direction while alternately offset in this direction, so that the ink droplets ejected from ejection openings located at the opposite ends of the arrangement are prevented from deflecting to the center of the arrangement and from generating white streaks when the solid printing is carried out.

15 Claims, 13 Drawing Sheets

--Prior Art--

LIQUID EJECTING HEAD HAVING A PLURALITY OF GROUPS OF EJECTION OPENINGS, AND IMAGE-FORMING DEVICE USING THE SAME

This application is based on Patent Application No. 2001-187107 filed Jun. 20, 2001 in Japan, the content of which is incorporated hereinto by reference.

BACKGROUND OF THE INVENTION

1. Field of the Invention

The present invention relates to a liquid ejection head having orifices for ejecting liquid and an image-forming device using the same.

In this specification, the word "print" refers to not only forming significant information, such as characters and figures, but also forming images, designs or patterns on a printing medium and processing, such as etching and so forth, of the printing medium, whether the information is significant or insignificant and whether it is visible so as to be perceived by humans or not. The term "printing medium" includes not only paper used in common printing apparatus, but also sheet materials such as cloths, plastic films, metal sheets, glass plates, ceramic sheets, wood panels and leathers, and three-dimensional materials such as spheres, round pipes and so forth which can receive the ink. The word "ink" should be interpreted in its wide sense as with the word "print", and it refers to liquid that is applied to the printing medium for forming images, designs or patterns, processing, such as etching, of the printing medium, or processing, such as coagulating or insolubilizing a colorant in the ink, and it includes any liquids used for printing.

2. Description of the Related Art

Recently, demand for high gradation color printing has risen as the internet or digital cameras become popular, and ink jet printers having a higher performance have been developed therewith. The following methods (1) to (3) are known for obtaining a high precision, high gradation and high quality printed image:

(1) The arrangement pitch of orifices for ejecting ink is minimized to improve the resolution.

(2) A plurality of print heads, each ejecting (at least two kinds of) a specific color ink containing a coloring material of different ratios, i.e., different color concentrations, are prepared, and a deep ink and a light ink are selectively printed, one over the other if necessary, so that the gradation is improved.

(3) By varying a size or an amount of an ink droplet ejected from the orifice, the gradation is improved.

Since the above-mentioned method (3) is relatively difficult to be performed in a so-called bubble-jet type printer in which thermal energy is used for generating a bubble in the ink, the blowing pressure of which is used as energy for ejecting ink from the orifice of the print head, it is thought that the methods (1) and (2) are particularly effective for the bubble-jet type printer.

To realize the method (2), however, two or more print heads are necessary for a specific color ink, which results in a high cost. Accordingly, for the bubble-jet type printer, it is most preferable and convenient to adopt a method in which the arrangement pitch of the ejection openings is reduced as in the method (1) and the size of an individual ink droplet ejected from the respective ejection opening is minimized (for example, to 10 pico-liters or less) so that the resolution is improved. This is because the production cost hardly rises by this method.

A type of printer that communicates a bubble to the atmosphere via an ejection opening when a small ink droplet is ejected from the ejection opening, in which the bubble grows with the heating of ink due to the film boiling, is disclosed, for example, in Japanese Patent Application Laid-open Nos. 4-10940 (1992), 4-10941 (1992) and 4-10942 (1992). To differentiate such a type from the conventional bubble-jet type in which the ink droplet is ejected without communicating the bubble, which is growing due to the film boiling, with the atmosphere, the former type may be called a bubble-through type.

In the print head of the conventional bubble-jet type in which the ink droplet is ejected without communicating the bubble growing due to the film boiling with the atmosphere, it is necessary to reduce the cross-sectional area of the ink passage communicating with the ejection opening as the size of the ink droplet ejected from the ejection opening becomes smaller. Thereby, an inconvenience may occur in that the ejection speed of the ink droplet is decelerated because of the lowering of ejection efficiency. If the ejection speed of the ink droplet decelerates, the ejecting direction becomes unstable. In addition, the ink becomes gradually viscous, as moisture is vaporized while the print head is inoperative, causing the ink-ejection to be more unstable, resulting in premature ejection failure or other problems. As a result, the reliability may be lowered.

In this respect, the bubble-through type print head in which a bubble communicates with the atmosphere is suitable for ejecting an ink droplet, since the size of the ink droplet can be decided solely by the geometric configuration of the ejection opening. In addition, the bubble-through type print head is advantageous in that it is hardly affected by temperature or other factors and the ejection rate of the ink droplet is very stable in comparison with the conventional bubble-jet type print head. Accordingly, it is possible to relatively easily obtain a high precision, high gradation and high quality printed image.

To obtain the high precision, high gradation and high quality printed image, preferably, an ink droplet containing an extremely small amount of ink is ejected from an individual ejection opening during the printing operation. In this case, it is necessary to eject ink droplets from the ejection opening in a short period for the purpose of obtaining a high printing speed. Further, it is necessary to make the carriage carrying the print head thereon scan at a high speed relative to a printing medium in synchronism with a drive frequency of the print head. From this point of view, it could be said that the bubble-through type is particularly suitable for the ink jet printer.

A state of the ejection of ink droplet is depicted in FIG. 11, when a so-called "solid" printing is carried out on a printing medium, in which ink droplets are continuously ejected from all the ejection openings while subjecting the print head of such an ink jet type to scanning movement at a high speed together with the carriage along the printing medium. The direction of the scanning movement of the print head 1 is perpendicular to the plane of the paper in FIG. 11, and the non-illustrated ejection openings are arranged leftward and rightward in the drawing. When the image data is "solid", all of the ejection energy generating means (not shown) corresponding to the respective ejection openings are driven at a high driving frequency. Therefore, viscous air around the ink droplet 3 ejected from the ejection opening toward the printing medium 2 is also entrained therewith. As a result, a surface area 4 of the print head 1 containing the ejection openings of the print head is more decompressed than the periphery of the print head 1. Particularly, it has been found that the ink droplets 3 ejected from the ejection openings located at opposite ends of the orifice arrangement are sucked toward a center of the arrangement, whereby those ink droplets are not directed to their intended predetermined positions on the printing medium 2.

In addition, as is apparent from the graph of FIG. 12 illustrating the relationship between the total number of ejection openings actually used and the amount of positional deflection of an ink droplet ejected from an ejection opening located at the arrangement end relative to the printing medium, the deflection of the ejecting direction of the ink droplet 3 by the influence of the above-mentioned air stream becomes significant generally in proportional to the total number of ejection openings actually used.

FIG. 13 schematically illustrates a solid printed image formed on the printing medium when the scanning movement of the carriage is repeated under such a phenomenon. The carriage moves together with the print head from an upper area to a lower area in the drawing. It will be understood that, in this case, a white streak 7 is formed between a solid image 5 formed by the preceding scanning movement and another solid image 6 formed by the subsequent scanning movement.

Such an inconvenience is particularly significant in the bubble-through type ink jet printer having a small arrangement pitch of the ejection openings and capable of ejecting ink droplets containing a small amount of ink, as little as 10 pico-liters or less, in a short period by one drive operation.

To avoid this inconvenience, it is also possible to restrict the deflection of ejection of the ink droplets ejected from the ejection openings located at the respective opposite arrangement ends by enlarging the size of the ink droplets, i.e., by increasing the inertia mass of the ink droplets ejected from the ejection openings of the respective opposite arrangement ends. The enlargement of the ink droplet size, however, hinders the formation of a high precision and high gradation image. Further, the permeation of the ink droplets into the printing medium is retarded, and the printed image is liable to deteriorate with the swell of the printing medium. Alternatively, it is also possible to mitigate the above-mentioned inconvenience by suppressing the drive frequency for the ejection energy generating means to a lower level. When the drive frequency for the ejection energy generating means is set to a lower level, however, the printing speed becomes too slow to satisfy the user's need for obtaining high speed printing.

SUMMARY OF THE INVENTION

An object of the present invention is to provide a liquid ejection head used in an ink jet printer carrying out a printing operation by ejecting ink droplets at a high frequency while being subjected to the scanning movement transverse to the feeding direction of a printing medium, capable of minimizing the deflection of ink droplets ejected from ejection openings disposed at opposite ends of the arrangement thereof, so that no white streaks are generated even in a solid printing, and an image-forming apparatus using such a liquid ejection head.

A first aspect of the present invention is a liquid ejection head comprising a plurality of ejection openings arranged in the feeding direction of a printing medium and a plurality of ejection energy generating means for generating energy used for ejecting liquid from the ejection openings disposed in correspondence to the ejection openings, the liquid ejection head being subjected to scanning movement along a printing medium transverse to the feeding direction of the printing medium, wherein the ejection openings are divided into a plurality of groups arranged parallel to the scanning movement direction while alternately offset in this direction.

A second aspect of the present invention is a liquid ejection head comprising a plurality of ejection openings and a plurality of ejection energy generating means, each located in a flow passage communicating with a corresponding ejection opening, for generating energy used for ejecting liquid from the ejection openings, the liquid ejection head being subjected to scanning movement along a printing medium, wherein the ejection openings are divided into a plurality of groups arranged parallel to the scanning movement direction while alternately offset in this direction.

In the present invention, a plurality of groups of ejection openings are not arranged on the same straight line but are alternately offset in the direction parallel to the scanning movement direction, whereby the ink droplets ejected from the ejection openings disposed at the opposite ends of a respective group are only slightly deflected to a central area thereof.

According to the present invention, since a plurality of ejection heads are divided into a plurality of groups alternately offset from each other in the direction parallel to the scanning movement direction, even if an air stream is generated in a respective group of ejection openings, deflection of the liquid ejected from the arrangement ends of the respective group hardly occurs. In addition, since the adjacent groups of ejection openings are offset from each other in the scanning movement direction, it is possible to correct the positions of the liquid droplets ejected from the ejection openings disposed at opposite ends of the arrangement and finally reaching the printing medium, to their intended predetermined positions, so that a high precision, high gradation and high quality printed image free from white streaks is obtainable even in solid printing.

In the liquid ejection head according to the first or second aspect of the present invention, the plurality of groups of the ejection openings may comprise end groups located at opposite ends of the arrangement and a central group located in a central area of the arrangement. In this case, the end groups of the ejection openings are preferably offset relative to the central group of the ejection openings in the scanning movement direction. Thereby, it is possible to more securely correct the positions of the liquid droplets ejected from the ejection openings disposed at opposite ends of the arrangement and finally reaching the printing medium, to their intended predetermined positions.

In each of the end and central groups of the ejection openings, a plurality of ejection openings is preferably arranged on a straight line.

The plurality of groups of the ejection openings may comprise a first end group comprising ejection openings located at opposite ends of the arrangement, a central group located in a central area of the arrangement, and a second end group comprising ejection openings located between those of the first end group and the central group in relation to the arrangement direction. In this case, the first end group of ejection openings is preferably offset relative to the second group of ejection openings in the scanning movement direction.

In each of the first and second end groups and the central group of ejection openings, a plurality of ejection openings are preferably arranged on a straight line.

The end groups of ejection openings may comprise dummy ejection openings from which no liquid is ejected, and the dummy ejection openings may be located at opposite outer ends of the end groups of ejection openings. In this case, it is possible to supply liquid, as smoothly as in the groups of ejection openings in the central area, to those ejection openings at the opposite ends of the arrangement which are actually ejecting liquid therefrom.

The total number of ejection openings is preferably within a range from 64 to 2048. If the total number of ejection openings is 64 or more, the influence of the air stream accompanying the scanning movement of the carriage becomes larger, so as to facilitate the effect of the present invention. If the total number of the ejection openings is 2048 or less, it is possible to sufficiently enjoy the effect of the present invention, even if the number of ejection openings disposed at the ends offset in the scanning movement direction of the liquid ejection head is relatively small. The number of ejection openings forming the end group may be in a range from 2 to 32, excluding the dummy ejection openings. Thereby, it is possible to achieve the effect of the present invention.

Furthermore, a plurality of liquid passages, each of which is communicated with a corresponding ejection opening at one end, and a common liquid chamber communicating with the other end of the liquid passage may be provided to the liquid ejection head, and a length of a wall member partitioning every two adjacent liquid passages along the liquid passages may be equal in all the groups of the ejection openings. In this case, it is possible to supply liquid, as smoothly as in the groups of ejection openings in the central area, to the groups of ejection openings at the opposite ends of the arrangement.

The plurality of groups of the ejection openings may be divided into two sets arranged parallel to each other, and the ejection openings in one set may be shifted by half a pitch relative to those in the other set in the feeding direction of the printing medium. In this case, it is possible to obtain a liquid ejection head in which the ejection openings are arranged at a high density.

An arrangement pitch of the ejection openings is preferably within a range from 300 to 3600 dpi. If the arrangement pitch is 300 dpi or more, the influence of the air stream accompanying the scanning movement of the carriage becomes larger, so as to facilitate the effect of the present invention. If the arrangement pitch of the ejection openings is 3600 dpi or less, the influence of the air stream accompanying the scanning movement of the carriage is relatively small, whereby it is possible to sufficiently enjoy the effect of the present invention even if the number of ejection openings disposed at the ends offset in the scanning movement direction of the liquid ejection head is relatively small.

A volume of the liquid ejected from one ejection opening at one time is preferably within a range from 0.2 to 10 pico-liters. If the volume of liquid ejected from one ejection opening at one time is 0.2 pico-liters or more, the influence of the air stream accompanying the scanning movement of the carriage becomes relatively small, and it is possible to sufficiently enjoy the effect of the present invention even if the number of ejection openings disposed at the ends offset in the scanning movement direction of the liquid ejection head is relatively small. If the volume of liquid ejected from one ejection opening is 10 pico-liters or less, the influence of the air stream accompanying the scanning movement of the carriage becomes larger, whereby it is possible to sufficiently enjoy the effect of the present invention.

The ejection energy generating means comprises an electrothermal transducer for generating thermal energy for ejecting the liquid from the ejection opening by film-boiling of the liquid.

A third aspect of the present invention is an image-forming apparatus comprising an attaching portion for the liquid ejection head according to the first or second aspect of the present invention, and a carriage movable for scanning in the direction transverse to the feeding direction of the printing medium, wherein an image is formed on the printing medium by the liquid ejected from the ejection openings of the liquid ejection head.

In the image-forming apparatus according to the third aspect of the present invention, the attaching portion may have a carriage movable for scananing transverse to the feeding direction of the printing medium. In this case, the liquid ejection head is detachably mounted to the carriage via detachment/attachment means.

The scanning speed of the carriage is preferably within a range from 10 to 100 cm/sec. If the scanning speed is 10 cm/sec or more, the influence of the air stream accompanying the scanning movement of the carriage becomes larger, whereby it is possible to sufficiently enjoy the effect of the present invention. If the scanning speed of the carriage is 100 cm/sec or less, the influence of the air stream accompanying the scanning movement of the carriage becomes relatively smaller, whereby even if the number of ejection openings disposed at the ends offset in the scanning movement direction of the liquid ejection head is relatively small, it is possible to sufficiently enjoy the effect of the present invention.

The liquid may be ink and/or treatment liquid for adjusting the printing state of the ink on the printing medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The preferred embodiments in which an image-forming apparatus according to the present invention are applied to an ink jet printer will be described in detail with reference to FIGS. 1 to 10. In this regard, the present invention should not be deemed limited to these embodiments, but may include any combinations thereof or may be applied to other techniques to be contained in the concept of the present invention defined by the scope of the claims for patent in this specification.

Figure 1:
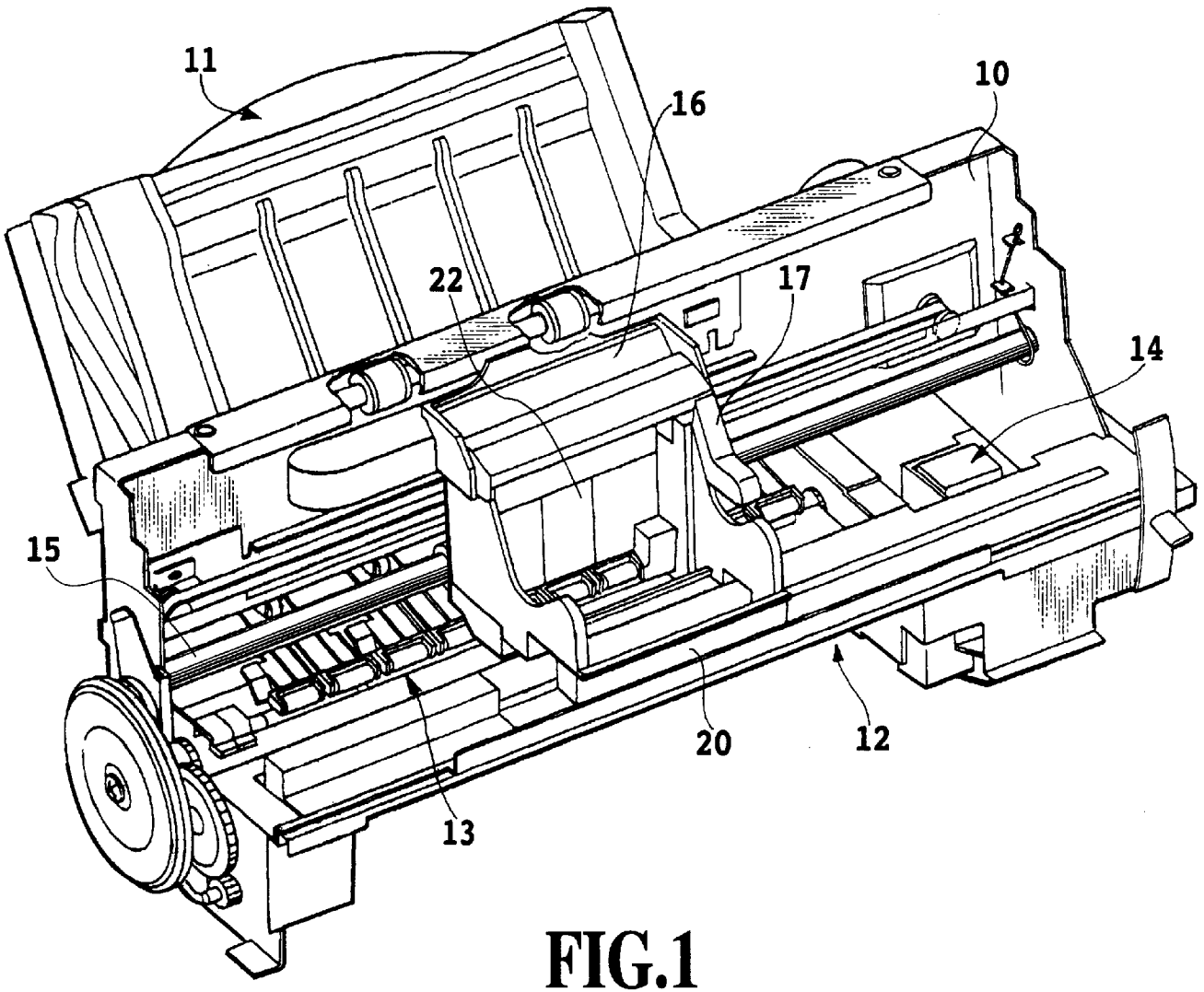
FIG. 1 is a perspective view schematically illustrating a structure of one embodiment of an image-forming apparatus according to the present invention applied to an ink jet printer.
Figure 2:
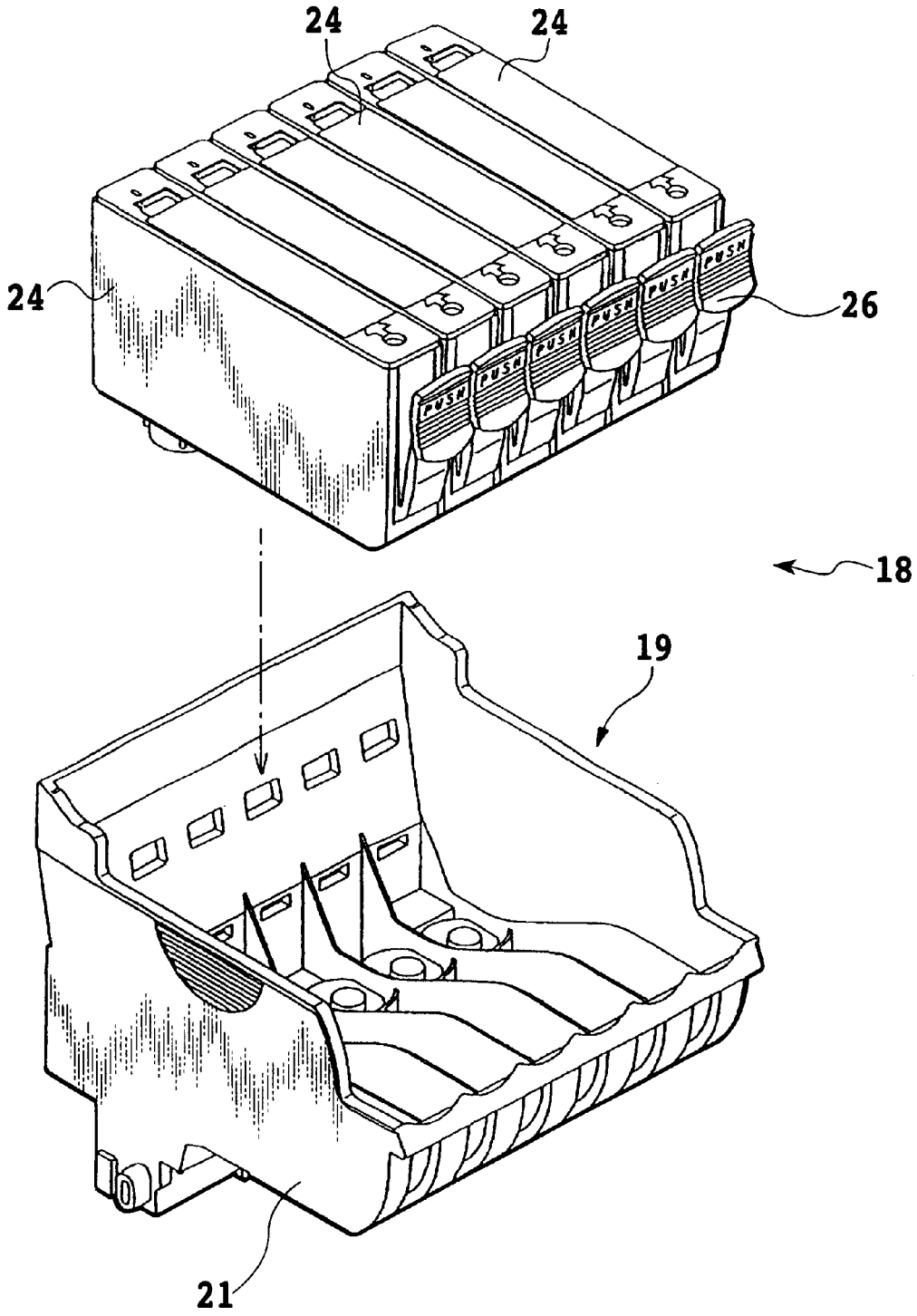
FIG. 2 is a perspective view of an appearance of one embodiment of a head cartridge carried on the ink jet printer shown in FIG. 1, illustrated in a disassembled state.
Figure 3:
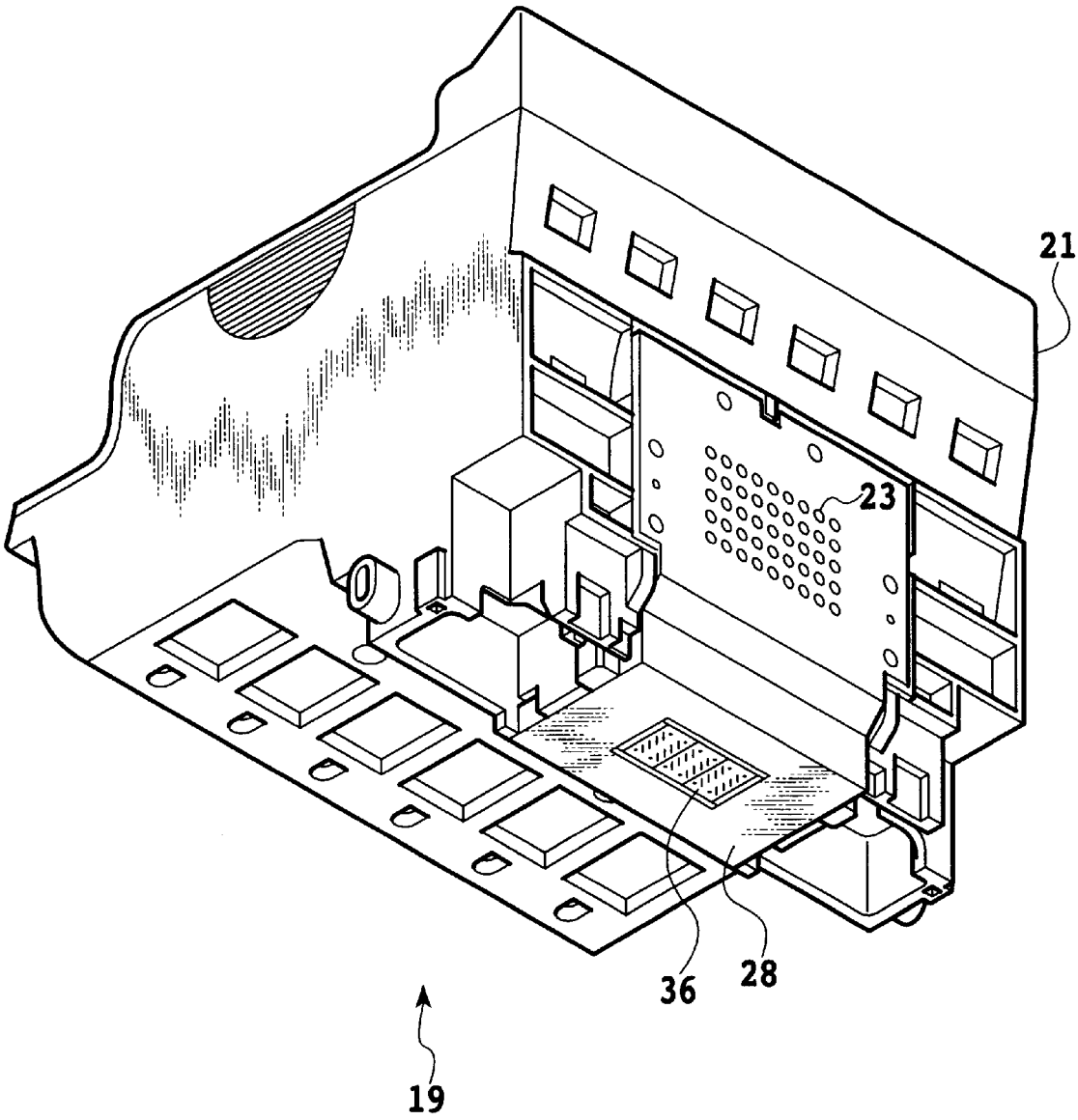
FIG. 3 is a perspective view of a print head of the head cartridge shown in FIG. 2.

A view of a mechanical part of an ink jet printer in this embodiment is shown in FIG. 1; a view of a head cartridge is shown in FIG. 2 in a disassembled state; and a view of a print head thereof is shown in FIG. 3. A chassis 10 of the ink jet printer in this embodiment is made from a plurality of metal sheet members having a predetermined rigidity to constitute a frame of the ink jet printer. The following sections are incorporated in the chassis 10; a medium-feeding section 11 for automatically feeding a sheet-like printing medium (not shown) into the ink jet printer, a medium-conveying section 13 for guiding the printing media one by one from the medium-feeding section 11 to a desired printing position and then to a medium-discharging section 12; a printing section for carrying out a predetermined printing operation on the printing medium conveyed to the printing position; and a head recovery section 14 for carrying out recovery treatment of the printing section.

The printing section includes a carriage 16 held to be movable along a carriage shaft 15 for scanning and a head cartridge 18 detachably carried on the carriage 16 via a head set lever 17.

The carriage 16 carrying the head cartridge 18 thereon is provided with a carriage cover 20 for locating a print head 19 of the head cartridge 18 at a predetermined mounting position on the carriage 16 and the above-mentioned head set lever 17 engaged with a tank holder 21 of the print head 19 to press and locate the print head 19 at a predetermined mounting position. The head set lever 17 used as attachment/detachment means of the present invention is provided in an upper portion of the carriage 16 to be rotatable relative to a head set lever shaft (not shown). A head set plate (not shown) biased by a spring (not shown) is provided in an engagement portion between the print head 19 and the carriage 16. Due to this spring force of the head set plate, the print head 19 is mounted to the carriage 16 in a pressed state.

One end of a contact flexible print cable (hereinafter referred to as a contact FPC) 22 is connected to another engagement portion of the carriage 16 with the print head 19. An electric contact is made between a contact section (not shown) formed at one end of the contact FPC 22 and a contact section 23 provided in the print head 19 as input terminals for external signals to feed/receive various kinds of information for the printing operation and to supply electric power to the print head 19.

An elastic member made, for example, of rubber or other material (not shown) is provided between the contact section of the contact FPC 22 and the carriage 16. The elastic force of this elastic member and the pressure applied by the head set plate ensure the contact between the contact section of the contact FPC 22 and the contact section 23 of the print head 19. The other end of the contact FPC 22 is connected to a carriage substrate (not shown) carried on a back surface of the carriage 16.

The head cartridge 18 in this embodiment has an ink tank 24 and the above-mentioned print head 19 for ejecting ink supplied from the ink tank 24 from the ejection opening 25 of the print head 19 (see FIG. 4) in accordance with the printing information. The print head 19 according to this embodiment is of a so-called cartridge type detachably mounted to the carriage 16.

According to this embodiment, to realize high quality color printing comparable to a photograph, for example, six independent ink tanks 24 for black, pale cyan, pale magenta, cyan, magenta and yellow inks are usable. Each respective ink tank 24 is provided with a resiliently deformable detachment lever 26 engageable with the head cartridge 18. By operating this detachment lever 26, it is possible to individually detach an ink tank 24 from the print head 19 as shown in FIG. 3.

Figure 4:
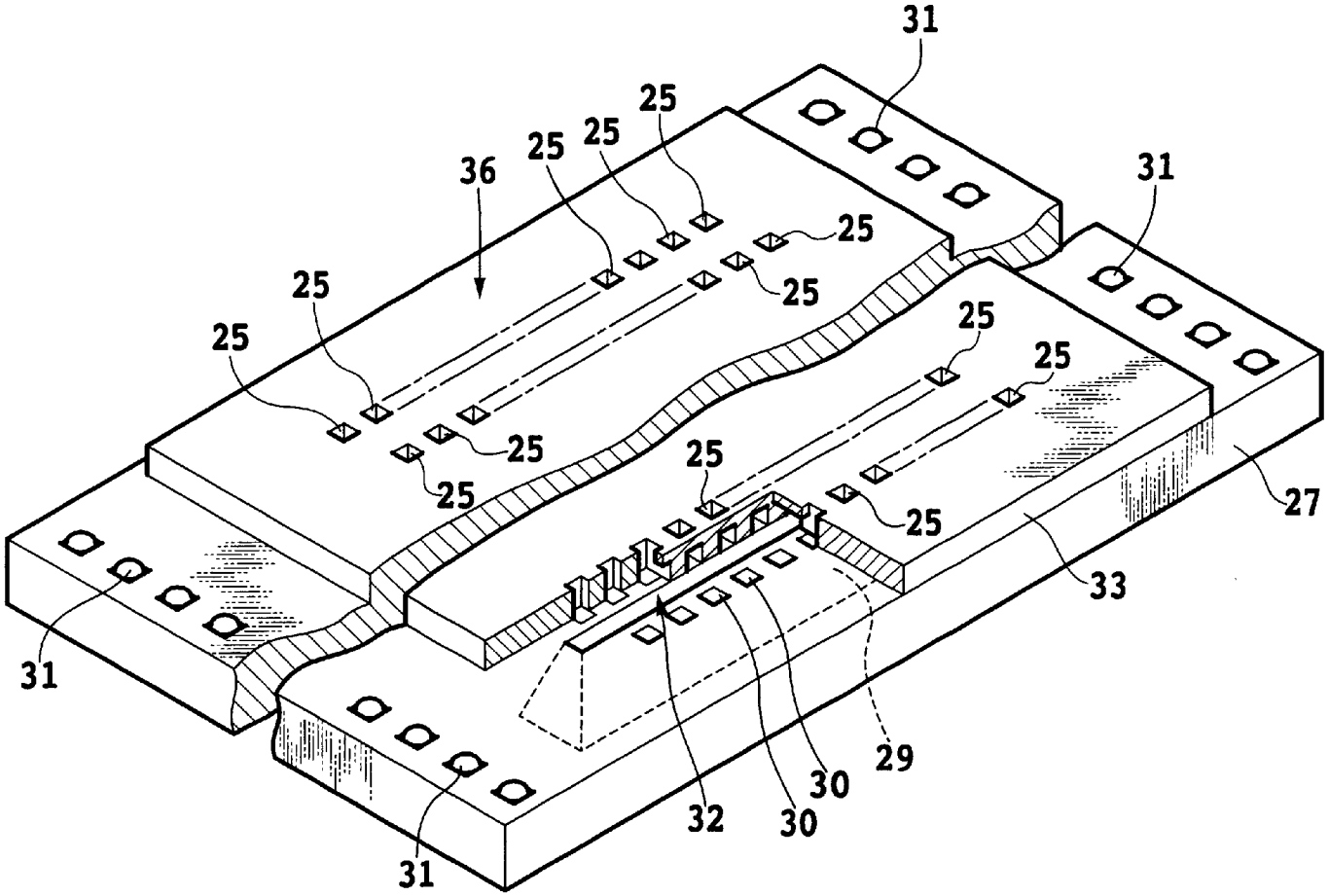
FIG. 4 is a broken perspective view of one embodiment of a liquid ejection head according to the present invention applied to the ink jet printer shown in FIG. 1.
Figure 5:
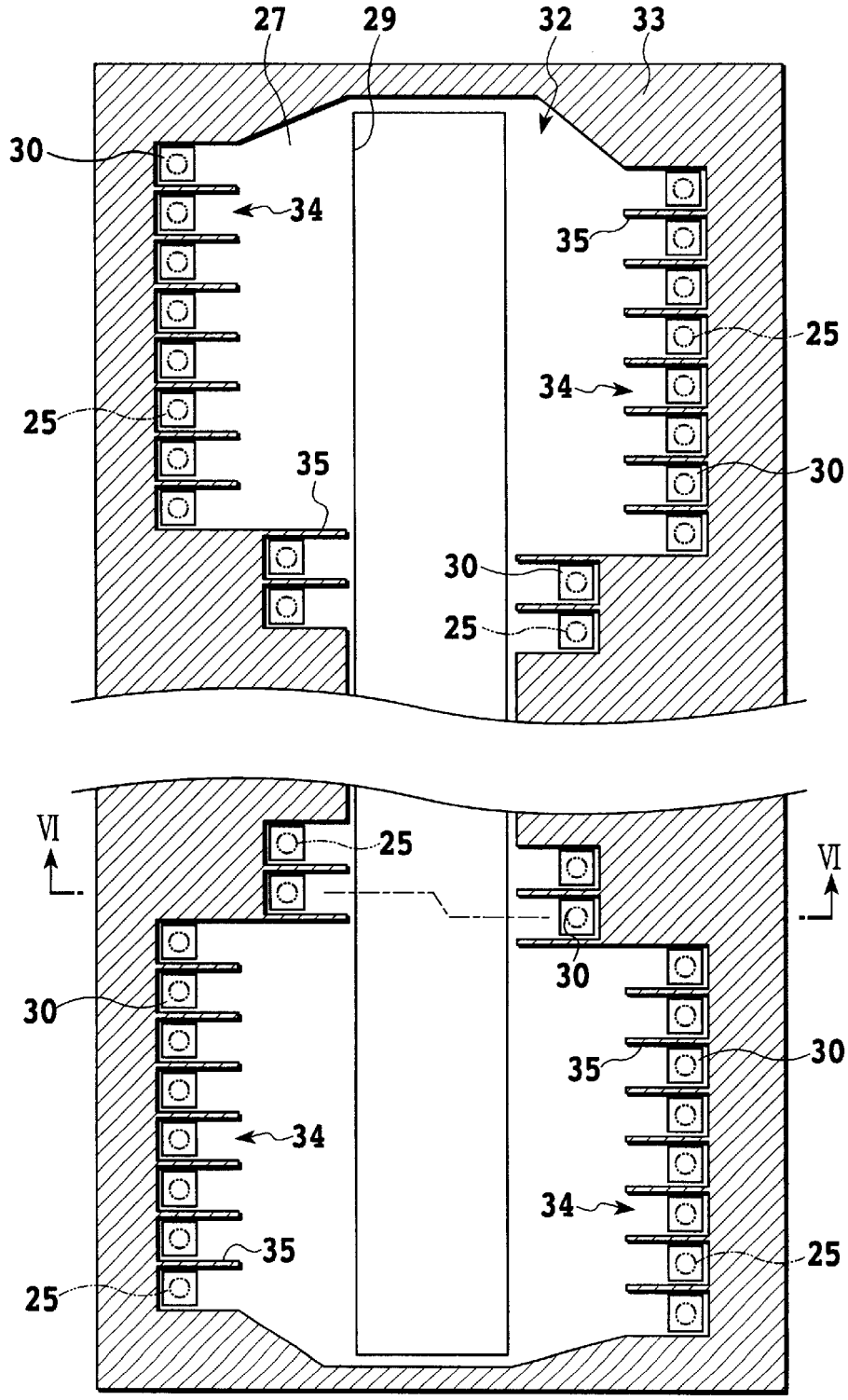
FIG. 5 is a sectional plan view of the ink jet head shown in FIG. 4.
Figure 6:
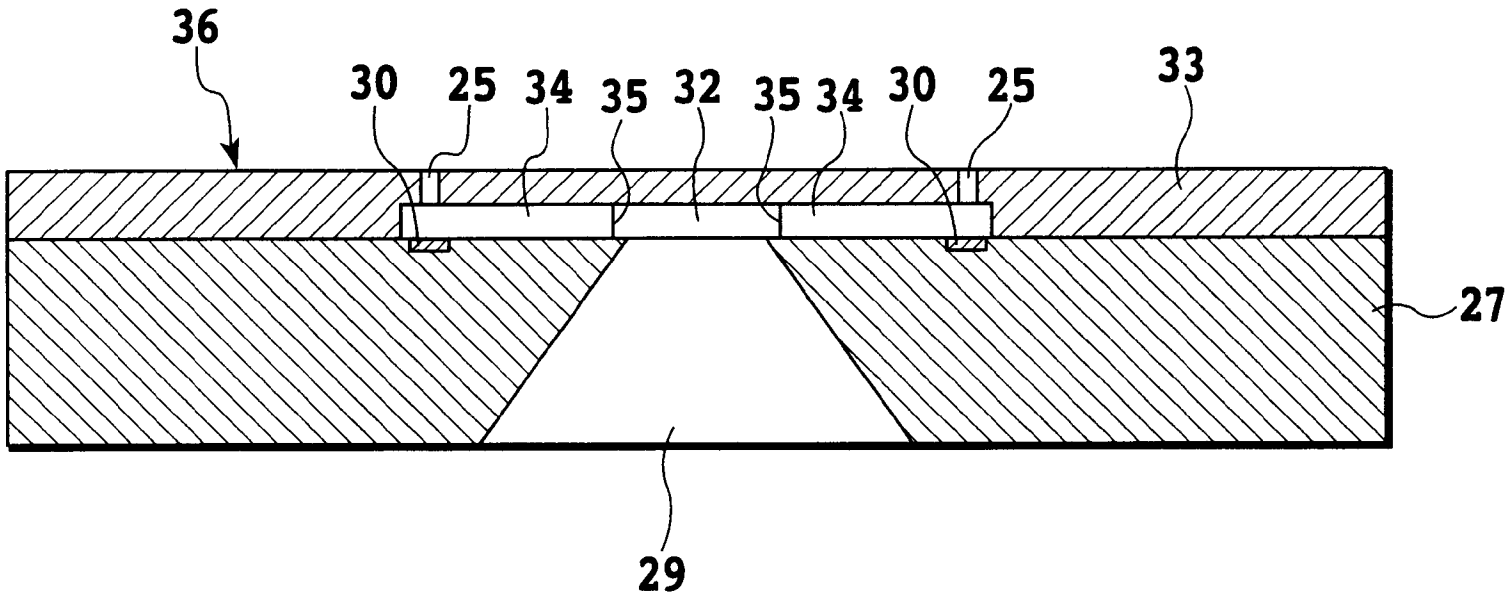
FIG. 6 is a sectional view taken along a line VI—VI in FIG. 5.

The print head 19 is constituted by an ejecting element substrate 27, an electric wiring substrate 28 described later and the above-mentioned tank holder 21 or others. FIG. 4 illustrates a broken structure of the ejecting element substrate 27 of the print head 19 according to this embodiment; FIG. 5 illustrates an arrangement pattern of the ejection openings; and FIG. 6 illustrates a cross-sectional structure thereof taken along a line VI—VI. The ejecting element substrate 27 in this embodiment is a silicon substrate 0.5 to 1 mm thick on which are formed ejection energy generating means, a common ink chamber 32, ink passages 34, ejection openings 25 and other elements as appropriate, by a deposition technique. An elongate ink supplying port 29 is provided through the ejecting element substrate 27. On both sides of the ink supplying port 29, a plurality (256 on each side in this embodiment) of electrothermal transducers 30 are arranged at a pitch in the feeding direction of the printing medium, i.e., in the longitudinal direction of the ink supplying port 29, shifted at half a pitch between opposite ones. Each of the electrothermal transducers 30 is an ejection energy generating means. In addition to the electrothermal transducers 30, electrode terminals 31 for the electric connection of the electrothermal transducers 30 with the printer body and aluminum electric wiring (not shown) are formed on the ejecting element substrate 27 by a deposition technique.

The electric wiring substrate 28 connected to the electrode terminals 31 formed on the ejecting element substrate 27 is used for feeding ink-ejection electric signals to the ejecting element substrate 27. The electric wiring substrate 28 has electric wiring corresponding to the ejecting element substrate 27, and the above-mentioned contact section 23 for receiving electric signals from the printer body. The contact section 23 is positioned and fixed onto a back surface of the tank holder 21. A drive signal is fed from a drive IC (not shown) to the electrothermal transducers 30 via the electric wiring substrate 28 and simultaneously therewith drive power is supplied to the electrothermal transducers 30.

Ink flow paths extending from the ink tanks 24 to the ink supplying port 29 of the ejecting element substrate 27 are formed in the tank holder 21 for detachably holding the ink tanks 24.

On the ejecting element substrate 27, an upper plate member 33 (see FIG. 5) is provided via the common ink chamber 32. The upper plate member 33 has a plurality of ejection openings 25 disposed directly opposite the electrothermal transducers 30. Between the upper plate member 33 and the ejecting element substrate 27, the ink passages 34 are formed for communicating the individual ejection openings 25 with the common ink chamber 32, and partitioning walls 35 are provided between adjacent ink passages 34. The common ink chamber 32, the ink passages 34, the partitioning walls 35 and other elements as appropriate are formed together with the upper plate member 33 by a photolithographic technique in the same manner as for the ejection openings 25.

A liquid supplied from the ink supplying port 29 to an ink passage 34 is boiled due to the heat generation by the corresponding electrothermal transducer 30 disposed opposite the ink passage 34, by the application of a drive signal to the electrothermal transducer 30, and the liquid is ejected from the corresponding ejection opening 25 by bubble pressure generated by the boiling. In this case, the bubble generated in the ink passage 34 directly beneath the ejection opening 25 communicates with the atmosphere through the ejection opening 25 as it grows.

The ejection openings 25 or the electrothermal transducers 30 on each side are arranged at a pitch of 600 dpi (42.3 μm), and those on one side are shifted relative to those on the other side by half a pitch of the arrangement of the ejection openings 25. Accordingly, the arrangement pitch of the ejection openings 25 on both sides is generally 1200 dpi. On both sides, the first to eighth ejection openings 25 and electrothermal transducers 30, starting from the opposite ends of the arrangement, are offset by 150 μm in the scanning movement direction relative to others located closer to a central area. In this embodiment, the distance between rows of the ejection openings located on the two sides, respectively, in the central area (i.e., in FIG. 5, a distance between center lines of the left and right rows of the ejection openings in the central area), is 215 μm. Accordingly, the distance between the two rows of the ejection openings located on the respective sides at the opposite ends of the arrangement is 515 μm. Since the ejection openings 25 and the electrothermal transducers 30 located at the opposite ends of the arrangement are offset in the scanning movement direction of the carriage 16, it is necessary to avoid the adverse effect caused by extending the distance between the ink supplying port 29 and these ejection openings 25. For this purpose, the length of the partitioning walls 35 of the ink passages 34 located at the opposite ends of the arrangement is shortened to be equal to the length of the partitioning walls 35 of the ink passages 34 arranged in the central area to facilitate the refill of ink in the ink passages 34 communicating with the ejection openings 25 disposed farther from the ink supplying port 29. Upon the application of a drive pulse for one operation of an individual electrothermal transducer 30, an ink droplet of 4.5 pico-liters having a density of 1.05 is ejected from the corresponding ejection opening 25.

Figure 13:
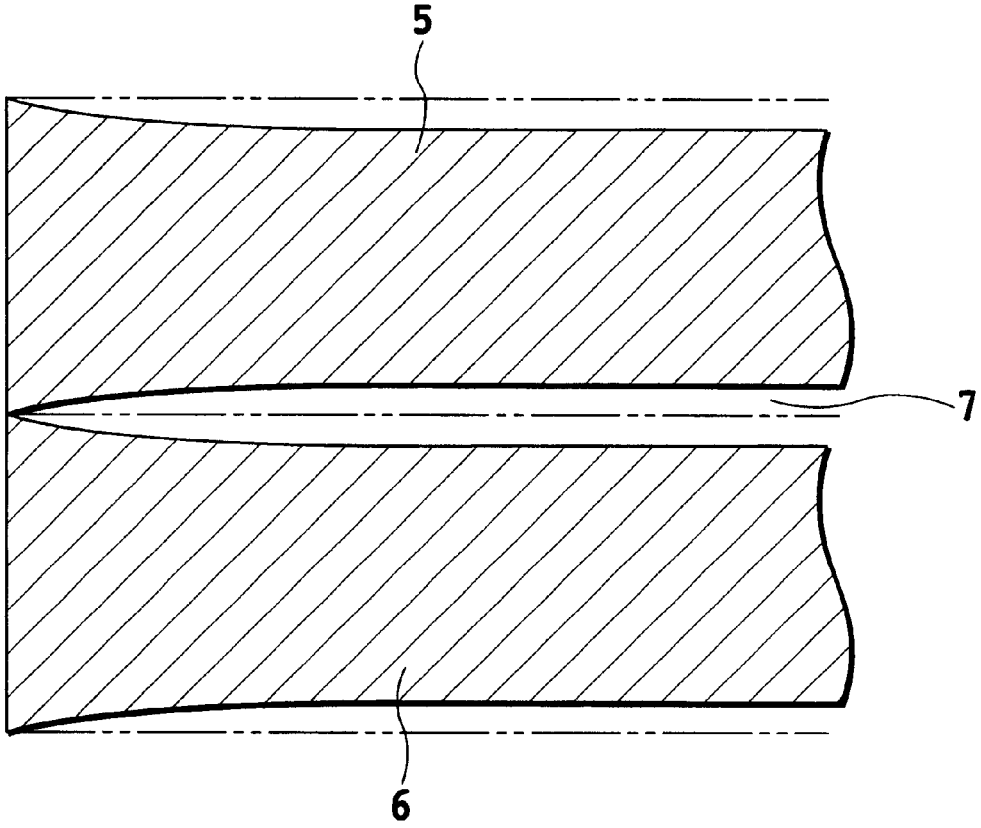
FIG. 13 is a conceptual view schematically illustrating a solid image formed on a printing medium by the ejection of ink shown in FIG. 12.

In a conventional print head, in which the ejection openings 25 of the respective rows are linearly arranged, it has been found that, when the ink droplets are continuously ejected from all the ejection openings while subjecting the ink jet type print head to scanning movement together with the carriage at a high speed along the printing medium to carry out a so-called solid printing on the printing medium, the width of a white streak as shown in FIG. 13 becomes as wide as approximately 40 μm. Contrary to this, in this embodiment, since 32 ejection openings 25 in total located at the opposite ends of the arrangement are offset in the scanning movement direction of the carriage 16 relative to the ejection openings 25 located in the central area, the ink droplets ejected from the former ejection openings 25 are hardly influenced by the air stream flowing toward the central area of the arrangement due to the decompressed atmosphere caused by the latter ejection openings 25 arranged in the central area, so that the white streak is minimized to approximately 18 μm in width. As a result, the white streak, which may be generated in every scanning movement of the carriage in the prior art, is suppressed.

A gap between the printing medium and an ejection opening surface 36 of the print head 19 on which the ejection openings 25 open was set at 1.5 mm when such a solid printing is carried out. Since the drive frequency for the electrothermal transducer 30 was set at 10 kHz, the scanning speed of the carriage 16 was set at 211.7 mm/s so that a dot pitch of 1200 dpi is obtained in the scanning direction of the carriage 16. In this case, the shortest ejection period of the ink droplet from one ejection opening 25 is approximately 67 μm.

Figure 7:
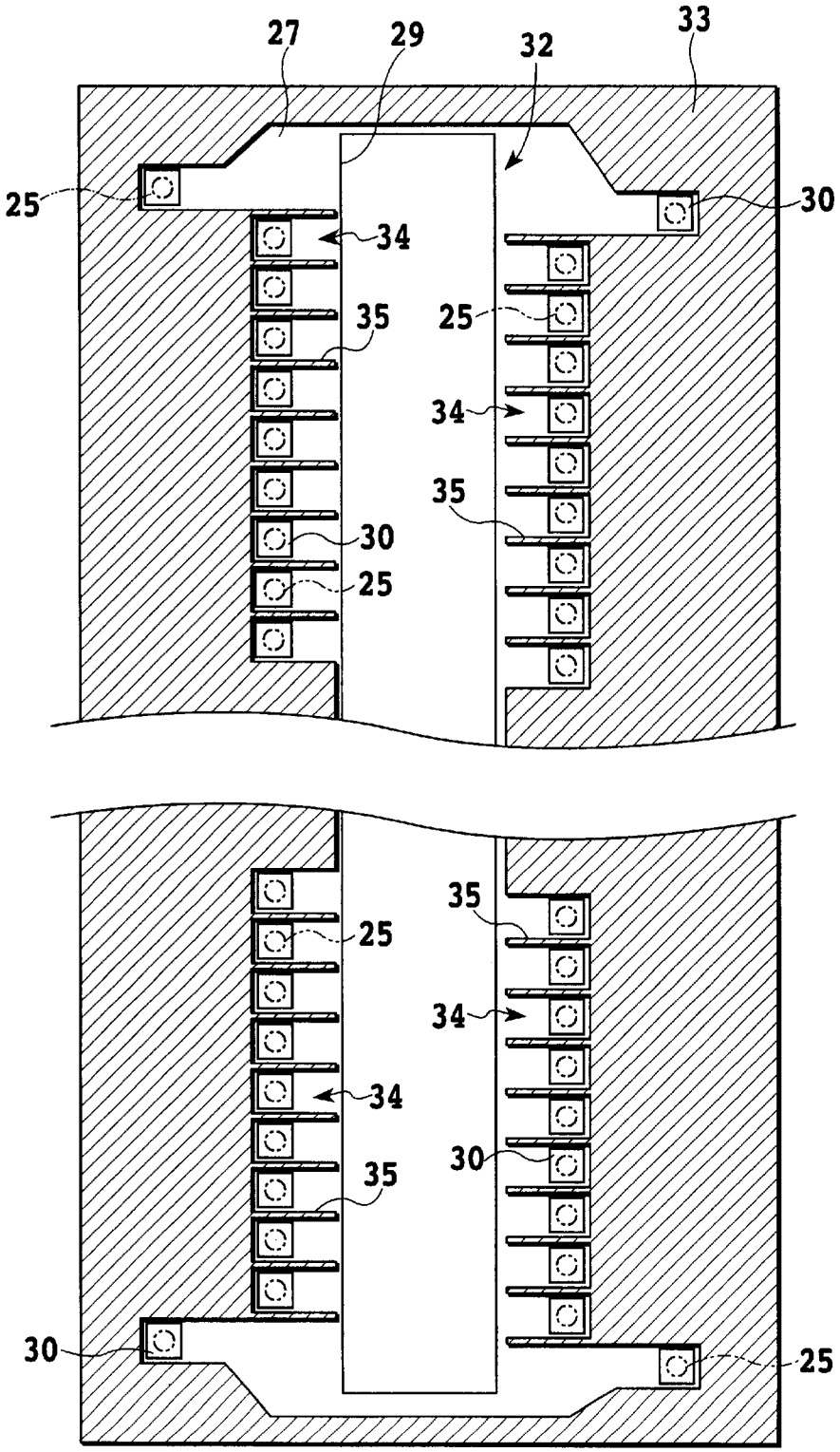
FIG. 7 is a sectional plan view of another embodiment of an ink jet head according to the present invention.

In the above-mentioned embodiment, the first to eighth ejection openings 25 and electrothermal transducers 30 at the respective opposite ends of the arrangement are offset in the scanning movement direction of the carriage 16 relative to the ejection openings 25 and the electrothermal transducers 30 located in the central area. As shown in FIG. 7, however, an arrangement may be provided in which only four of the ejection openings 25 and electrothermal transducers 30 located at the opposite ends of the arrangement are offset in the scanning movement direction of the carriage 16 relative to the ejection openings 25 located in the central area.

Figure 8:
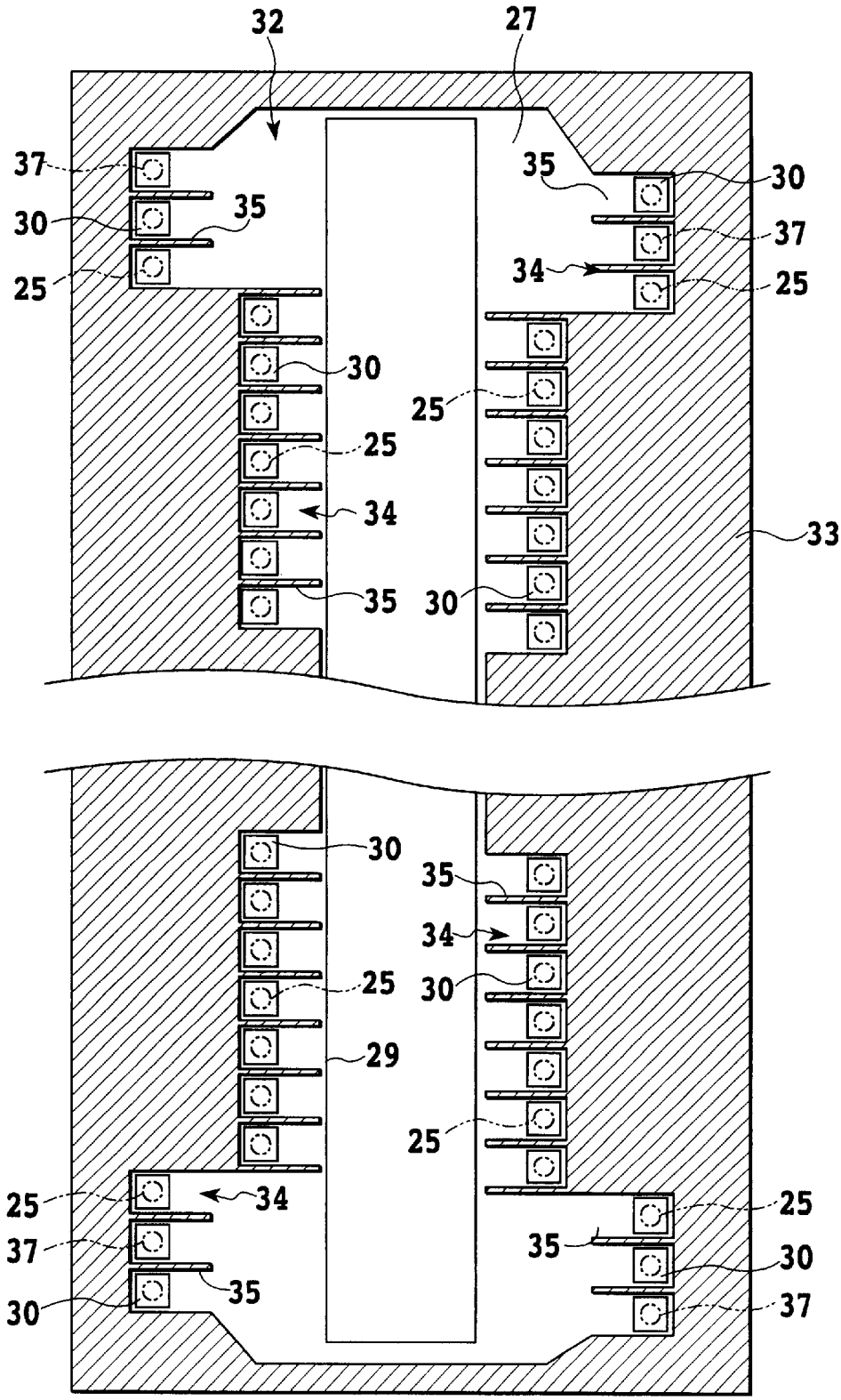
FIG. 8 is a sectional plan view of a further embodiment of an ink jet head according to the present invention.

Also, the present invention may be applied to a print head having dummy ejection openings from which no ink droplet is ejected when the image is formed. Such a structure of another embodiment according to the present invention is shown in FIG. 8, in which the same reference numerals are used for indicating elements having the same functions as in the preceding embodiment shown in FIG. 7. In the embodiment shown in FIG. 8, first and second ejection openings located at respective opposite ends of the arrangement are dummy ejection openings 37. These dummy ejection openings 37 and a third ejection opening 25 adjacent thereto are disposed to be offset in the scanning movement direction. In this case, it is necessary that the ejection openings 25 other than the dummy ejection openings 37 are those actually used for the image formation. The number of ejection openings 25 arranged in an offset manner is advantageously selected in a range from 2 to 32 in total. This number may be suitably selected in accordance with the gap between the printing medium and the ejection opening surface 36 of the print head 19, the density of the ink used, the volume of the ink droplets ejected from the ejection openings, and the arrangement pitch of the ejection openings 25, or other parameters.

In the print head of the embodiments shown in FIGS. 7 and 8, 126 ejection openings 25 (in the embodiment shown in FIG. 8, the dummy ejection openings 37 are included) are arranged in one row at a pitch of 600 dpi and shifted by ½ pitch relative to those in the other row in the same manner as in the preceding embodiment. The ejection opening 25 and the dummy ejection openings 37 disposed at the respective opposite ends of the arrangement are offset by 100 μm in the scanning movement direction relative to the ejection openings 25 located in the central area. Since the drive frequency for the electrothermal transducers 30 was set at 12.5 kHz, the scanning speed of the carriage 16 was set at approximately 265 mm/s so that a dot pitch of 1200 dpi is obtainable in the scanning direction of the carriage 16. In this case, the shortest ejection period of the ink droplet from one ejection opening 25 is approximately 80 μm.

In these embodiments, similar to the preceding embodiment, it is possible to prevent white streaks from occurring when solid printing is carried out. If the scanning movement of the carriage 16 is not carried out in a reciprocal manner during the printing operation, it is possible to minimize the deflection of the ink droplets ejected from the ejection openings 25 disposed at the respective opposite ends of the arrangement by offsetting these ejection openings 25 in the scanning movement direction of the carriage 16.

Figure 9:
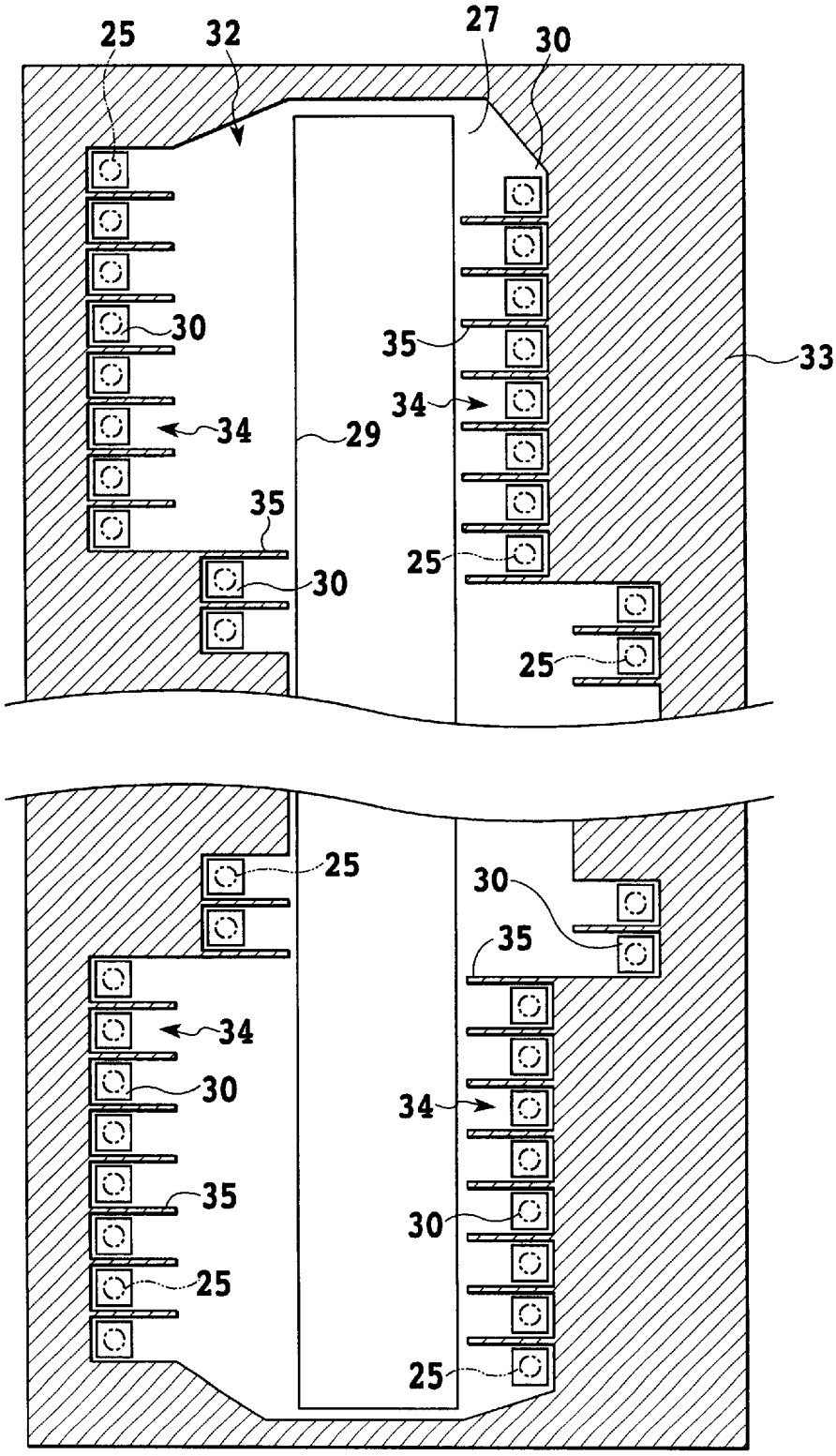
FIG. 9 is a sectional plan view of a furthermore embodiment of an ink jet head according to the present invention.

Thus, in the carriage 16 adapted to carry out the printing operation by a one-way scanning movement, as shown in FIG. 9, it is effective if the ejection openings 25 and the electrothermal transducers 30 located at the opposite ends of the arrangement are offset in the scanning movement direction of the carriage 16 (leftward in the drawing) relative to the ejection openings 25 disposed in the central area. It is thought this is because an air stream generated on the ejection opening surface 36 (having the ejection openings 25) when the carriage 16 moves gets behind a row of ink droplets ejected from the ejection openings 25. The print head 19 according to this embodiment has two rows of ejection openings 25, each row having 256 of them, as in the embodiment shown in FIG. 5. The first to eighth ejection openings 25 and electrothermal transducers 30 at the respective opposite ends of the arrangement are offset by 100 $\mu$m in the scanning movement direction relative to the ejection openings 25 located in the central area.

When so-called solid printing is carried out by continuously ejecting ink droplets from all the ejection openings 25 while subjecting such an ink jet type print head 19 to the scanning movement together with the carriage 16 along the printing medium, the width of the white streak is as narrow as approximately 12 $\mu$m according to this embodiment, while this width increases to 18 $\mu$m according to the alternative in which the first to eighth ejection openings 25 and electrothermal transducers 30 at the respective opposite ends of the arrangement are offset by 100 $\mu$m in a direction opposite to the scanning movement direction relative to the ejection openings 25 located in the central area. It will be understood that a better printed image is obtainable as a result.

Figure 12:
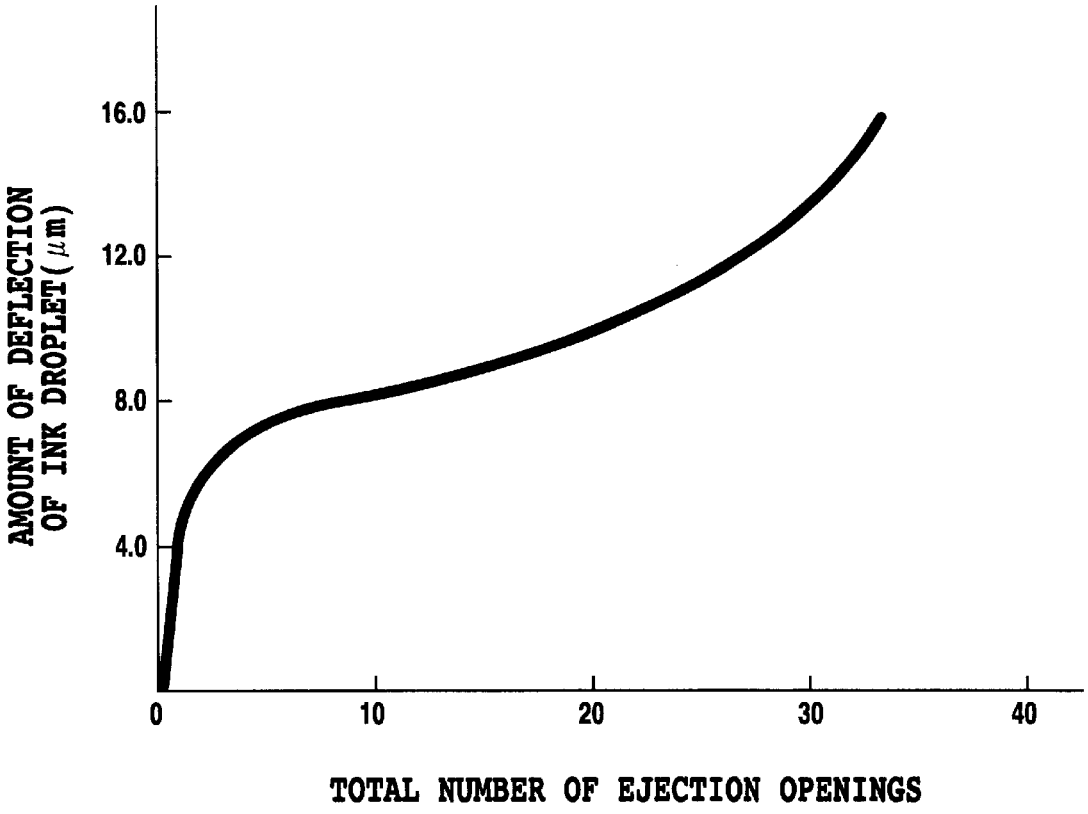
FIG. 12 is a graph illustrating the relationship between the total number of ejection openings for ejecting ink droplets and the amount of deflection of the ink droplets ejected from the ejection openings located at each of the opposite ends of the arrangement thereof relative to a printing medium.

It is apparent from the experimental result illustrated in FIG. 12 that the deflection of ink droplets ejected from ejection openings 25 located at the ends of the arrangement is not so conspicuous when the number of ejection openings 25 linearly arranged is approximately 16 or less. Based on such knowledge, it is also possible to form groups, each having 2 to 16 linearly arranged ejection openings 25, and to arrange the groups while alternately offsetting them in the scanning movement direction of the carriage 16, whereby the deflection of ink droplets ejected from the groups located at the respective opposite ends of the arrangement is minimized.

Figure 10:
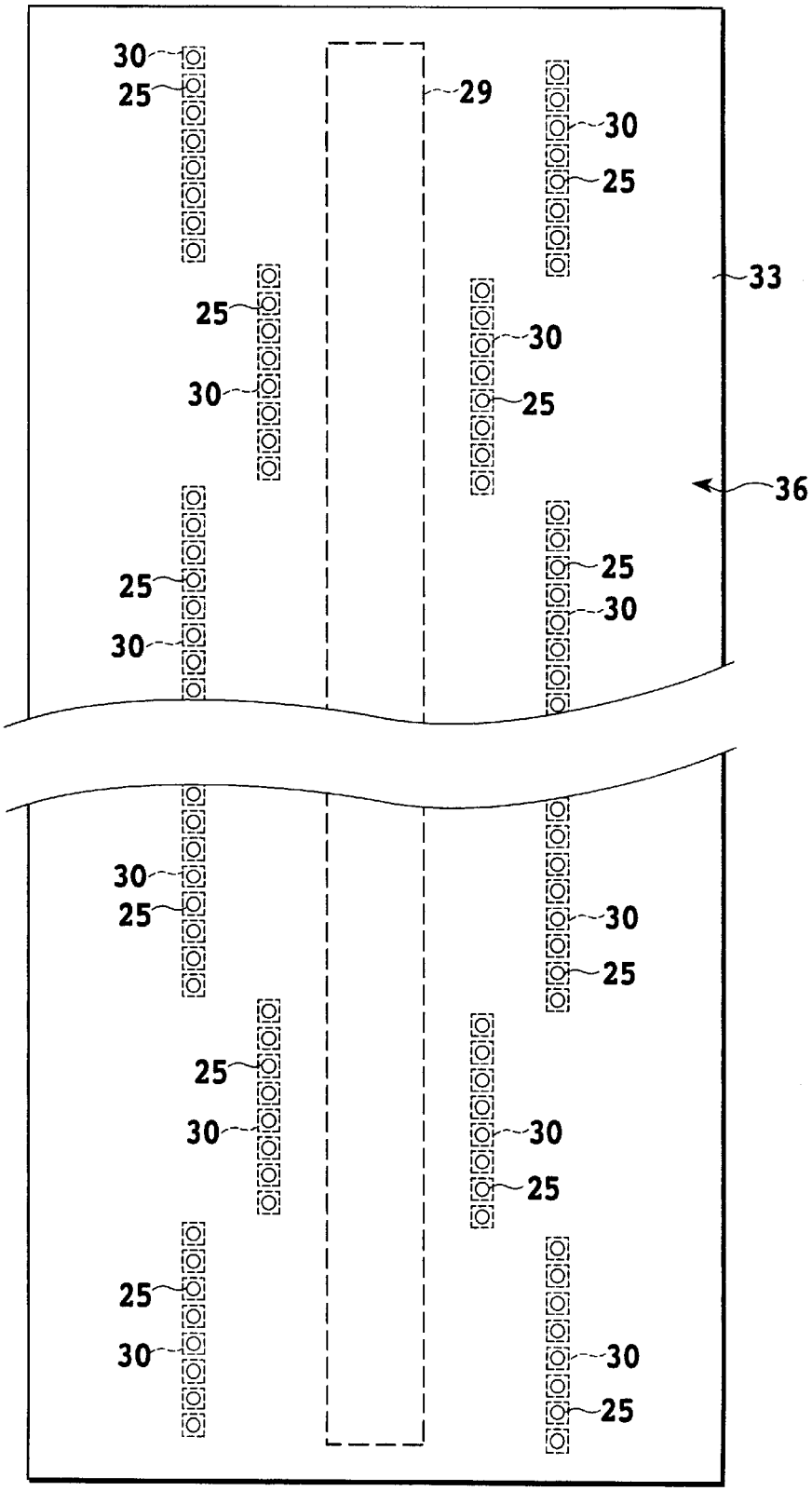
FIG. 10 is a plan view of a still further embodiment of an ink jet head according to the present invention.
Figure 11:
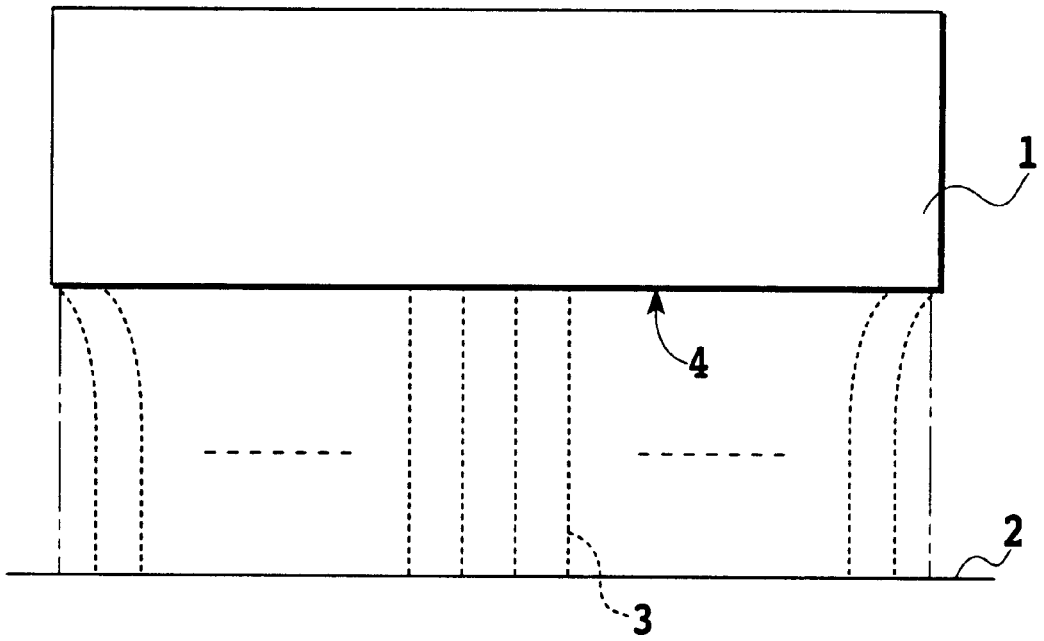
FIG. 11 is a conceptual view schematically illustrating an ink ejection state in the prior art ink jet printer.

Such an arrangement of the ejection openings in the print head according to the present invention is schematically illustrated in FIG. 10, wherein the same reference numerals are used for indicating elements having the same function as in the preceding embodiments and the superfluous explanation thereof is eliminated. In this embodiment, groups, each consisting of eight ejection openings 25, are arranged while alternately offsetting the groups in the scanning movement direction of the carriage 16. Four rows of ejection openings 25 are arranged in left-right symmetry while interposing the common ink supplying port 29. In this case, sixteen ejection openings of each group located at the most opposite ends of the arrangement (i.e., thirty-two ejection openings in total) correspond with a first end group of ejection openings according to the present invention, and the next sixteen ejection openings of each group (i.e., thirty-two ejection openings in total), adjacent to the first end group of ejection openings, correspond with a second end group of ejection openings according to the present invention.

According to this embodiment, even if the printing operation is carried out by using solely the ejection openings 25 located in the central area of the arrangement, it is always possible to minimize the deflection of the ink droplets ejected from the ejection openings 25 located at the ends of the arrangement. For example, when the printing operation is carried out by using 256 ejection openings 25 located in the central area of the arrangement, the deflection of the ink droplets ejected from the ejection openings 25 disposed at the ends of the arrangement is approximately 21 $\mu$m in the prior art. On the contrary, in this embodiment, the deflection is suppressed to approximately 9 $\mu$m. When so-called solid printing is carried out by using all the ejection openings 25, the width of the white streak reaches approximately 60 $\mu$m in the prior art, while it is suppressed to approximately 24 $\mu$m in this embodiment.

In this embodiment, one group is formed by the succeeding eight ejection openings 25 arranged in one row and offset from the adjacent group. However, the same effect is obtainable even if one group is formed by approximately 16 ejection openings 25 or less and offset from the adjacent one, as is apparent from FIG. 12.

The present invention achieves a distinct effect when applied to a liquid ejecting head, a head cartridge, or an image printing apparatus which has a means for generating thermal energy, such as electrothermal transducers or a laser beam, and which causes changes in ink by thermal energy so as to eject liquid. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid, and it operates as follows: first, one or more driving signals are applied to the electrothermal transducers to cause thermal energy to be generated corresponding to printing information; second, the thermal energy induces sudden a temperature rise beyond the nucleate boiling temperature so as to cause film boiling on heating portions of the liquid ejecting head; and third, bubbles are grown in the liquid corresponding to the driving signals. By using the growth and collapse of the bubbles, the ink is expelled from at least one of the ejecting ports of the head to form one or more liquid drops. A driving signal in the form of a pulse is preferable because the growth and collapse of the bubbles can be achieved instantaneously and suitably by this form of driving signal. As driving signals in the form of a pulse, those described in U.S. Pat. Nos. 4,463,359 and 4,345,262 are preferable.

In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a liquid ejecting head, which is incorporated into the present invention: this structure includes heating portions disposed on bent portions in addition to a combination of the ejecting ports, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejecting ports of the electrothermal transducers, and the latter discloses a structure in which openings for absorbing pressure waves caused by thermal energy are formed corresponding to the ejecting ports. Thus, irrespective of the type of the liquid ejecting head, the present invention can achieve printing positively and effectively.

In addition, the present invention can be applied to various serial type liquid ejecting heads: a liquid ejecting head fixed to the main assembly of an image printing apparatus; a conveniently replaceable chip type liquid ejecting head which, when loaded on the main assembly of a image printing apparatus, is electrically connected to the main assembly, and is supplied with liquid therefrom; and a cartridge type liquid ejecting head integrally including a liquid reservoir.

It is further preferable to add a recovery system for keeping the ejecting head in adequate condition for ejecting liquid, or a preliminary auxiliary system for a liquid ejecting head as a constituent of the image printing apparatus, because they serve to make the effect of the present invention more reliable. Examples of a recovery system include a capping means and a cleaning means for the liquid ejecting head, and a pressure or suction means for the liquid ejecting head. Examples of a preliminary auxiliary system include a preliminary heating means utilizing electrothermal transducers or a combination of other heater elements and the electrothermal transducers, and a means for carrying out preliminary ejection of liquid independently of the ejection for printing. These systems are effective for reliable printing.

The number and type of liquid ejecting heads to be attached to an image printing apparatus can also be varied. For example, only one liquid ejecting head corresponding to a single color ink, or a plurality of liquid ejecting heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, the treatment liquid (the printability-enhancing liquid) for adjusting the printing state of the ink may also be ejected from each individual head or a common ejecting head to the printing medium in accordance with the kind of the printing medium or the printing mode.

Furthermore, although the above-described embodiments use liquids, liquids that are liquid or liquids that are solid when the printing signal is applied can be used. For example, liquids can be employed that solidify at a temperature lower than room temperature and are softened or liquefied at room temperature. This is because in the ink jet system, the temperature of the liquid is generally adjusted to be kept in a range of 30° C. to 70° C. so that the viscosity of the liquid is maintained at such a value that the liquid can be ejected reliably. In addition, the present invention can be applied to apparatuses in which the liquid is liquefied just before ejection thereof by thermal energy so that the liquid is expelled from the ejection ports in the liquid state, and then begins to solidify on hitting the printing medium, thereby preventing liquid evaporation. For example, the liquid is transformed from the solid to the liquid state by positively utilizing the thermal energy which would otherwise cause the temperature rise; or the liquid, which is dry when left in air, is liquefied in response to the thermal energy of the printing signal. In such cases, the liquid may be retained in recesses or through holes formed in a porous sheet as liquid or solid substances so that the liquid faces the electrothermal transducers as described in Japanese Patent Application Laid-open Nos. 54-56847(1979) or 60-71260 (1985). The present invention is most effective when it uses the film boiling phenomenon to expel the liquid.

Furthermore, the image printing apparatus according to the present invention can be employed not only as an image output terminal of an information processing device such as a computer, but also as an output device of a copying machine combined with a reader or the like, a facsimile apparatus having a transmission and receiving function, or a printing press for cloth. A sheet or web paper, a wooden or plastic board, a stone slab, a plate glass, metal sheet, a three dimensional structure or the like may be used as the printing medium according to the present invention.

The present invention has been described in detail with respect to preferred embodiments, and it will now be apparent from the foregoing to those skilled in the art that changes and modifications may be made without departing from the invention in its broader aspects, and it is the intention, therefore, in the claims appended hereto to cover all such changes and modifications as fall within the true spirit of the invention.

What is claimed is:

1. A liquid ejection head comprising a plurality of ejection openings arranged in a feeding direction of a printing medium and a plurality of ejection energy generating means for generating energy used for ejecting liquid from the ejection openings disposed in correspondence to the ejection openings, and subjected to a scanning movement along the printing medium transverse to the feeding direction of the printing medium, wherein the ejection openings are divided into a plurality of groups arranged alternately offset in a direction parallel to the scanning movement direction, the plurality of groups of the ejection openings comprising end groups located at opposite ends of the arrangement and a central group located in a central area of the arrangement, each of the groups comprising at least one ejection opening, and wherein in at least one of the end and central groups of the ejection openings, a plurality of ejection openings are arranged on a straight line.

2. A liquid ejection head as claimed in claim 1, wherein the end groups of the ejection openings are offset in the scanning movement direction relative to the central group of the ejection openings.

3. A liquid ejection head as claimed in claim 1, wherein the plurality of groups of the ejection openings comprise a first end group comprising ejection openings located at opposite ends of the arrangement, a central group comprising ejection openings located in a central area of the arrangement, and a second end group comprising ejection openings located between those of the first end group and those of the central group in relation to the arrangement direction.

4. A liquid ejection head as claimed in claim 3, wherein the first end group of the ejection openings is offset in the scanning movement direction relative to the second end group of the ejection openings.

5. A liquid ejection head as claimed in claim 3, wherein in each of the first and second end groups and the central groups of the ejection openings, a plurality of ejection openings are arranged on a straight line.

6. A liquid ejection head as claimed in claim 1, wherein the end groups of the ejection openings comprise dummy ejection openings from which no liquid is ejected, said dummy ejection openings being located at opposite outer ends of the end groups of the ejection openings.

7. A liquid ejection head as claimed in claim 6, wherein a total number of the plurality of ejection openings is within a range of 64 to 2048, and a total number of the ejection openings forming the end groups is within a range of 2 to 32, excluding the dummy ejection openings.

8. A liquid ejection head as claimed in claim 1, further comprising a plurality of liquid passages, one end of each of which is communicated with one of the ejection openings, and a common liquid chamber communicating with the other ends of the liquid passages, wherein lengths of wall members partitioning adjacent liquid passages are equal in all the groups of the ejection openings.

9. A liquid ejection head as claimed in claim 1, wherein the plurality of groups of the ejection openings are divided into two sets arranged parallel to each other, the ejection openings in one set being shifted by half a pitch relative to those in the other set in the feeding direction of the printing medium.

10. A liquid ejection head as claimed in claim 1, wherein an arrangement pitch of the ejection openings is within a range of 300 to 3600 dpi.

11. A liquid ejection head as claimed in claim 1, wherein a volume of the liquid ejected from one ejection opening at one time is within a range of 0.2 to 1.0 pico-liter.

12. A liquid ejection head comprising a plurality of ejection openings and a plurality of ejection energy generating means, each located in a flow passage communicating with a corresponding one of the ejection openings, for generating energy used for ejecting liquid from the ejection openings, and subjected to a relative movement with respect to a printing medium, wherein the ejection openings are divided into a plurality of groups arranged alternately offset in a direction parallel to the relative movement direction, the plurality of groups of the ejection openings comprising end groups located at opposite ends of the arrangement and a central group located in a central area of the arrangement, each of the groups comprising at least one ejection opening, and wherein in at least one of the end and central groups of the ejection openings, a plurality of ejection openings are arranged on a straight line.

13. An image-forming apparatus comprising:

an attaching portion for the liquid ejection head as claimed in claim 1; and a carriage movable for the scanning in the direction transverse to the feeding direction of the printing medium, wherein an image is formed on the printing medium by the liquid ejected from the ejection openings of the liquid ejection head.

14. An image-forming apparatus as claimed in claim 13, wherein a scanning speed of the carriage is within a range of 10 to 100 cm/sec.

15. An image-forming apparatus comprising:

an attaching portion for the liquid ejection head as claimed in claim 12, wherein an image is formed on the printing medium by the liquid ejected from the ejection openings of the liquid ejection head.

* * * * *

UNITED STATES PATENT AND TRADEMARK OFFICE

CERTIFICATE OF CORRECTION

PATENT NO. : 6,848,769 B2
DATED : February 1, 2005
INVENTOR(S) : Shuichi Murakami It is certified that error appears in the above-identified patent and that said Letters Patent is hereby corrected as shown below:

Title page,
Item [57], ABSTRACT, replace with the following:
-- A liquid ejection head includes a plurality of ejection openings arranged in the feeding direction of a printing medium and a plurality of ejection energy generating elements for generating energy used for ejecting liquid from the ejection openings disposed in correspondence to the ejection openings. The liquid ejection head is subjected to scanning movement along the printing medium transverse to the feeding direction of the printing medium. The ejection openings are divided into a plurality of groups arranged parallel to the scanning movement direction while alternately offset in this direction, so that ink droplets ejected from ejection openings located at opposite ends of the arrangement are prevented from being deflected to the center of the arrangement and from generating white streaks when solid printing is carried out. --.

Column 3,
Line 13, “proportional” should read -- proportion --.

Column 6,
Line 11, “scananing” should read -- scanning --.

Signed and Sealed this

Twenty-fifth Day of October, 2005

JON W. DUDAS
*Director of the United States Patent and Trademark Office*